US005424183A

United States Patent [19]

Ishida et al.

[11] Patent Number: 5,424,183

[45] Date of Patent: Jun. 13, 1995

[54] BALLASTED LEUCO DYES AND PHOTOTHERMOGRAPHIC ELEMENT CONTAINING SAME

[75] Inventors: Takuzo Ishida, Woodbury; Roger A. Mader, Stillwater; Doreen C. Lynch, Afton, all of Minn.; Tran V. Thien, Harlow, Great Britain; Kenneth L. Hanzalik, Arden Hills, Minn.

[73] Assignee: Minnesota Mining and Manufacturing Company, St. Paul, Minn.

[21] Appl. No.: 200,925

[22] Filed: Feb. 22, 1994

Related U.S. Application Data

[63] Continuation of Ser. No. 31,672, Mar. 15, 1993, abandoned.

[51] Int. Cl.[6] ..... G03C 1/494; G03C 1/498; G03C 8/14; G03C 8/40

[52] U.S. Cl. ..... 430/619; 430/203; 430/223; 430/351; 430/542

[58] Field of Search ..... 430/203, 223, 351, 542, 430/619

[56] References Cited

U.S. PATENT DOCUMENTS

| | | | |
|---|---|---|---|
| 2,784,186 | 3/1957 | Adams et al. | 260/243 |
| 3,457,075 | 7/1969 | Morgan et al. | 96/67 |
| 3,531,286 | 9/1970 | Renfrew | 96/67 |
| 3,839,049 | 10/1974 | Simons | 96/114.6 |
| 3,985,565 | 10/1976 | Gabrielsen et al. | 96/114.1 |
| 4,187,108 | 2/1980 | Willis | 430/203 |
| 4,260,677 | 4/1981 | Winslow et al. | 430/618 |
| 4,374,921 | 2/1983 | Frenchik | 430/358 |
| 4,426,441 | 1/1984 | Adin et al. | 430/351 |

(List continued on next page.)

FOREIGN PATENT DOCUMENTS

| | | |
|---|---|---|
| 0244399 | 11/1987 | European Pat. Off. . |
| 52-89131 | 7/1977 | Japan . |
| 59-5239 | 1/1984 | Japan . |

OTHER PUBLICATIONS

H. A. Lubs, *The Chemistry of Synthetic Dyes and Pigments;* Hafner; New York, N.Y., 1955; Chapter 5.

H. Zolliner, *Color Chemistry: Synthesis, Properties and Applications of Organic Dyes and Pigments;* VCH; New York, N.Y.; pp. 67–73, 1987.

*Primary Examiner*—Charles L. Bowers, Jr.
*Assistant Examiner*—J. Pasterczyk
*Attorney, Agent, or Firm*—Gary L. Griswold; Walter N. Kirn; Mark A. Litman

[57] ABSTRACT

Heat-developable photothermographic materials capable of providing stable color images of high resolution. These materials comprise a support bearing a layer of an image-forming composition comprising:

(a) a photosensitive silver halide,
(b) an organic silver compound,
(c) a reducing agent for silver ion, and
(d) a binder, The reducing agent comprises a ballasted leuco dye compound. The ballasted leuco dye compound comprises a compound of the general formula:

D—B wherein

D represents the reduced chromophore of a thermally mobile dye; and

B represents an organic group that reduces the thermal mobility of D in the aforementioned binder, said organic group B capable of being oxidatively cleaved. The molecular weight of B must not be so high that the resulting amount of D in the emulsion layer is insufficient to yield a dye image having a reflection optical density of at least 0.3 or a transmission optical density of at least 0.2. Advantages of the heat-developable photothermographic materials of this invention include the following:

(1) capability of providing of pure, clear, and stable positive dye images at high photographic speed;
(2) low silver requirement; and
(3) reduced background stain.

16 Claims, No Drawings

U.S. PATENT DOCUMENTS 4,439,280 3/1984 Gendler et al. ..... 204/2
4,460,681 7/1984 Frenchik ..... 430/502
4,500,626 2/1985 Naito et al. ..... 430/351
4,551,740 11/1985 Hung ..... 346/218
4,563,415 1/1986 Brown et al. ..... 430/340
4,570,171 2/1986 Hung ..... 346/218
4,587,211 5/1986 Ishida et al. ..... 430/619
4,594,307 6/1986 Ishida ..... 430/203
4,622,395 11/1986 Bellus et al. ..... 544/37
4,647,525 3/1987 Miller ..... 430/341
4,670,374 6/1987 Bellus et al. ..... 430/351
4,708,928 11/1987 Geisler ..... 430/619
4,795,697 1/1989 Vogel et al. ..... 430/619
4,981,775 1/1991 Swain et al. ..... 430/203
5,149,807 9/1992 Hammond et al. ..... 544/99

BALLASTED LEUCO DYES AND PHOTOTHERMOGRAPHIC ELEMENT CONTAINING SAME

This is a continuation of application Ser. No. 08/031,672 filed Mar. 15, 1993 now abandoned.

BACKGROUND OF THE INVENTION

1. Field of the Invention

This invention relates to leuco dyes, and, more particularly, to ballasted leuco dyes that are suitable for use in photothermographic imaging systems.

2. Discussion of the Art

Photothermographic imaging materials (i.e., heat-developable photographic materials) that are classified as "dry silver" compositions or emulsions comprise (1) a light-insensitive, reducible silver source, (2) a light-sensitive material that generates elemental silver when irradiated, and (3) a reducing agent for the reducible silver source. The light-sensitive material is generally photographic silver halide, which must be in catalytic proximity to the light-insensitive, reducible silver source. Catalytic proximity requires an intimate physical association of these two materials so that when silver specks. or nuclei are generated by the irradiation or light exposure of the photographic silver halide, those nuclei are able to catalyze the reduction of the reducible silver source. It has long been understood that silver metal ($Ag^{\circ}$) is a catalyst for the reduction of silver ions. A progenitor of the light-sensitive photographic silver halide may be placed into catalytic proximity with the light-insensitive, reducible silver source in a number of different fashions, such as partial metathesis of the reducible silver source with a halogen-containing source (see, for example, U.S. Pat. No. 3,457,075), coprecipitation of silver halide and reducible silver source material (see, for example, U.S. Pat. No. 3,839,049), and other methods that intimately associate the light-sensitive photographic silver halide and the light-insensitive, reducible silver source.

The light-insensitive, reducible silver source. is a material that contains silver ions. The preferred light-insensitive reducible silver source comprises silver salts of long chain aliphatic carboxylic acids, typically having from 10 to 30 carbon atoms. The silver salt of behenic acid or mixtures of acids of similar molecular weight are generally used. Salts of other organic acids or other organic materials, such as silver imidazolates have been proposed, and U.S. Pat. No. 4,260,677 discloses the use of complexes of inorganic or organic silver salts as light-insensitive, reducible silver sources.

In both photographic and photothermographic emulsions, exposure of the photographic silver halide to light produces small clusters of silver atoms ($Ag^{\circ}$). The imagewise distribution of these clusters is known in the art as a latent image. This latent image generally is not visible by ordinary means and the light-sensitive emulsion must be further processed in order to produce a visible image. The visible image is produced by the reduction of silver ions, which are in catalytic proximity to silver halide grains bearing the clusters of silver atoms, i.e. the latent image.

As the visible image is produced entirely by silver atoms ($Ag^{\circ}$), one cannot readily decrease the amount of silver in the emulsion without reducing the maximum image density. However, reduction of the amount of silver is desirable in order to reduce the cost of raw materials used in the emulsion.

One conventional way of attempting to increase the maximum image density of photographic and photothermographic emulsions without increasing the amount of silver in the emulsion layer is by incorporating dye-forming materials in the emulsion. Such dye-forming materials include leuco dyes, which are the reduced form of a color-bearing dye. Upon imaging, the leuco dye is oxidized, and the color-bearing dye and a reduced silver image are simultaneously formed in the exposed region. In this way a dye enhanced silver image can be produced, as shown for example in U.S. Pat. Nos. 3,531,286; 4,187,108; 4,426,441; 4,374,921; and 4,460,681. However, when the reactants and reaction products of photothermographic systems that contain leuco dyes remain in contact after imaging, several problems can result. For example, thermal development often forms turbid and hazy color images because of dye contamination of the reduced metallic silver image in the exposed area of the emulsion. In addition, the resulting prints tend to develop color in unimaged background areas. This "background stain" is caused by slow reaction between the leuco dye and oxidizing agent during storage.

One method of inhibiting background stain is to transfer the color-bearing dye from the photothermographic emulsion to a receptor. However, it is essential that the rate of diffusion of the leuco dye and the color-bearing dye be significantly different to provide good color separation and background stability. One method of dye transfer involves thermal diffusion, that is, heat-induced transfer of a dye by diffusion to an image-receiving layer. This method requires a significant difference in rate of thermal diffusion between the leuco dye and the oxidized leuco dye, i.e. the color-bearing dye. Only the color-bearing dye is transferred; the silver image and unoxidized leuco dye are left behind in the emulsion. In addition, the rate of thermal diffusion of other photographic addenda, such as antihalation dyes, acutance dyes, sensitizing dyes, toners, developers, stabilizers, antifoggants, etc., must be low so that these materials remain behind in the emulsion. All of these addenda can cause stain and reduce image stability. Japanese Kokai No. 59-5239 and U.S. Pat. No. 4,594,307 disclose photothermographic systems that rely on different rates of thermal diffusion for the leuco dye and the color-bearing dye.

A system wherein different components have different rates of thermal diffusion presents several problems. Only a limited number of color-bearing dyes are both diffusible and amenable to being formed into a leuco dye. It is difficult for a dye to diffuse through a binder, even more so through several layers of a photothermographic element. In multiple color systems, different rates of dye formation and migration through multiple layers must be controlled to achieve proper color balance in the final print. Also, prolonged heating to induce the dyes to diffuse may cause fogging.

It would be desirable to provide leuco dyes that not only strongly resist migration, but also exhibit a great diffusion differential between the color-bearing dye and the leuco dye, i.e. the reduced form of the color-bearing dye.

SUMMARY OF THE INVENTION

The present invention provides heat-developable photothermographic materials capable of providing stable color images of high resolution. These materials comprise a support bearing an image-forming composition comprising:

(a) a photosensitive silver halide, (b) an organic silver compound, (c) a reducing agent for silver ion, and (d) a binder.

The reducing agent comprises a ballasted leuco dye compound.

The ballasted leuco dye compound comprises a compound of the general formula:

D—B wherein

D represents the reduced chromophore of a thermally mobile dye; and

B represents an organic ballasting group that reduces the thermal mobility of D in the aforementioned binder. B is preferably of sufficient molecular weight to render said compound D—B thermally immobile, said organic group B capable of being oxidatively cleaved. The molecular weight of B must not be so high that the resulting amount of D in the emulsion layer is insufficient to yield a dye image having a reflection optical density of at least 0.3 or a transmission optical density of at least 0.2. In general, B preferably has a molecular weight of at least about 183, more preferably of at least about 237, and most preferably of at least about 337.

Photographic elements derived from the materials of this invention are capable of producing a silver image and a thermally mobile dye in the part corresponding to the silver image, at the same time, by carrying out heat development after imagewise exposure to light. After imagewise exposure to light, heating produces an oxidation-reduction reaction between (1) the organic silver compound and/or silver halide and (2) the reducing agent by means of exposed, photosensitive silver halide as a catalyst, to form a silver image in the exposed areas. In this reaction the reducing agent is oxidized by the organic silver salt compound and/or silver halide to form an oxidized product, with concomitant release of a thermally mobile color-bearing dye. Accordingly, the silver image and the thermally mobile color-bearing dye are obtained at the exposed area and a color image is obtained by transferring the thermally mobile dye to an image receiving layer which may be present in the element or may be a separate sheet which is placed in contact with the element during heat development.

The preferred ballasted leuco dye compounds of this invention have the general formula:

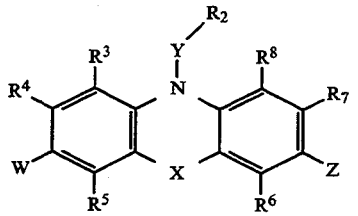

I wherein

X represents a member selected from the group consisting of S, O, and N—$R^1$;

$R^1$ represents a member selected from the group consisting of alkyl groups and aryl groups;

Y—$R^2$ represents an organic group which may be oxidatively cleaved, wherein

Y represents a member selected from the group consisting of, $$-\overset{O}{\overset{\|}{C}}-O-,\ -\overset{O}{\overset{\|}{C}}-NH-,\ -\overset{O}{\overset{\|}{C}}-,\ \text{and}\ -SO_2-,$$

$R^2$ represents an organic-ballasting group;

$R^3$, $R^4$, $R^5$, $R^6$, $R^7$, and $R^8$ each independently represents a member selected from the group consisting of hydrogen, halogens, and alkyl groups, preferably having from 1 to 4 carbon atoms, and aromatic rings fused in the 1,2 and 8,9 positions;

W represents a member selected from the group consisting of hydrogen, alkyl groups, preferably having from 1 to 4 carbon atoms, alkoxy and alkylthio groups, preferably having from 1 to 4 carbon atoms, —OH, —SH, —NHCOR$^9$, —OCOR, and —NR$^9$R$^{10}$.

Z represents a member selected from the group consisting of —OH, —SH, —NHCOR$^9$, —OCOR$^9$, and —NR$^9$R$^{10}$;

$R^9$ and $R^{10}$ each independently represents a member selected from the group consisting of hydrogen, alkyl groups, aryl groups, aralkyl groups, 1-naphthoyl group, 2-naphthoyl group, and —COR$^{11}$, where $R^{11}$ represents a member selected from the group consisting of hydrogen, alkyl groups, aryl groups, aralkyl groups, 1-naphthoyl group, and 2-naphthoyl group, provided that if either $R^9$ or $R^{10}$ is hydrogen, the other is not hydrogen;

$R^9$ and $R^{10}$ together may represent the necessary atoms to complete a 5-, 6-, or 7-membered heterocyclic ring group; or one or more of $R^9$ to $R^{10}$ may represent the atoms necessary to complete a 5- or 6-membered heterocyclic ring group fused to the phenyl ring on which the —NR$^9$R$^{10}$ group is attached.

The present invention also provides novel leuco dye compounds capable of resisting migration when incorporated in a polymeric binder. The ballasted leuco dyes of this invention are inexpensive to prepare and are capable of serving both as developer and dye progenitor. The ballasted leuco dyes of this invention can be readily and conveniently synthesized.

Advantages of the heat-developable photothermographic materials of this invention include the following:

(1 ) capability of providing pure, clear, and stable positive dye images. at high photographic speed;

(2 ) low silver requirement; and (3 ) reduced background stain.

DETAILED DESCRIPTION OF THE INVENTION

As used herein, the phrase "capable of resisting migration" means capable of remaining in the layer of photothermographic material so that formation of a visually observable discoloration in the background area of an image-receiving layer is minimized.

The term "emulsion layer" means a layer of a photothermographic element that contains the light-sensitive silver salt and the silver source material.

The term "thermally mobile" means capable of diffusion or migration under influence of heat through a polymeric binder.

The term "thermally immobile" means capable of resisting migration or diffusion through a polymeric binder under the influence of heat.

The term "color-bearing dye" means the colored, oxidized form of the corresponding leuco dye.

The term "reduces the thermal mobility in a polymeric binder" means lowering the rate of diffusion or migration in a polymeric binder.

The photothermographic element of this invention comprises at least one photosensitive layer comprising (1) a photosensitive silver halide, (2) an organic silver compound which serves as a source of reducible silver, (3) a ballasted leuco dye which serves as a reducing agent for the silver ion of the organic silver compound, and (4) a binder. The photothermographic element may further comprise an image-receiving layer. After the photothermographic element is imagewise exposed, the photosensitive layer is subjected to thermal treatment. Upon application of a sufficient amount of heat, e.g., sufficient to provide a rise in temperature of from about 25° C. to about 80° C. to 160° C., the leuco dye will undergo a change in color and will be capable of transferring by diffusion to an image receiving layer. As used herein, the term "change in color" includes (1) a change from an uncolored or lightly colored state (optical density less than 0.2) to a colored state (an increase in optical density of at least 0.2 units), and (2) substantial change in hue.

The ballasted leuco dye can be any colorless or lightly colored compound that can be oxidized to a colored form, when heated, preferably to a temperature of from about 80° C. to about 250° C. (176° F. to 482° F.) for a duration of from about 0.5 to about 300 seconds and can diffuse through emulsion layers and interlayers into the image receiving layer of the article of the invention. Any ballasted leuco dye capable of being oxidized by silver ion to form a visible image can be used in the present invention. Leuco dyes that are both pH sensitive and oxidizable can be used but are not preferred. Leuco dyes that are sensitive only to changes in pH are not included within scope of dyes useful in this invention because they are not oxidizable to a colored form.

Representative classes of leuco dyes that are capable of being ballasted and are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307, both of which are incorporated herein by reference.

One class of ballasted leuco dyes useful in this invention are those derived from imidazole dyes. Non-ballasted imidazole leuco dyes are described in U.S. Pat. No. 3,985,565.

Another class of ballasted leuco dyes useful in this invention are those derived from so-called "chromogenic dyes." These dyes are prepared by oxidative coupling of a p-phenylenediamine with a phenolic or anilinic compound. Non-ballasted leuco dyes of this class are described in U.S. Pat. No. 4,594,307. Cyan leuco chromogenic dyes are described in assignee's copending application U.S. Ser. No. 07/939,093, incorporated herein by reference.

A third class of dyes useful in this invention are "aldazine" and "ketazine" dyes. Dyes of this type are described in U.S. Pat. Nos. 4,587,211 and 4,795,697, both of which are incorporated herein by reference.

The preferred class of ballasted leuco dyes are reduced forms of dyes having a diazine, oxazine, or thiazine nucleus. The preferred ballasted leuco dyes suitable for use in this invention are represented by formula I. In the ballasted leuco dyes of formula I, X represents O, S, or N—$R^1$, where $R^1$ represents an alkyl or aryl group. The alkyl group or aryl group can be unsubstituted or substituted. Where $R^1$ represents an alkyl group, it is preferred that it contain from 1 to 10 carbon atoms. Where $R^1$ represents an aryl group, it is preferred that it have up to three fused rings, more preferably that it be a phenyl ring. Whether $R^1$ is an alkyl group or an aryl group, $R^1$ can contain various substituents so long as they are inert to the photothermographic system, not injurious to the migration of the resultant formed dye, and not injurious to quality of the resultant formed image. Such substituents can include, but are not limited to, alkyl groups, preferably having from 1 to 4 carbon atoms; alkoxy and thioalkoxy groups, preferably having from 1 to 4 carbon atoms; halogen atoms, such as fluoro, chloro, bromo, or iodo; and cyano groups.

The group —Y—$R^2$ is essential to the leuco dye compounds and provides several valuable properties to the leuco dye compounds. The group is stable to heat and does not release the thermally mobile image-forming dye until the leuco dye is oxidized, whereby the group —Y—$R^2$ is cleaved. In other words, when the group Y—$R^2$ is oxidatively cleaved from the leuco dye, the image-forming dye, i.e., the color-bearing dye, is released. The leuco dye is rapidly oxidized by the reducible silver source in the presence of a latent image, i.e. $Ag^{\circ}$, to release a thermally mobile color-bearing dye capable of forming an image. A primary function of the group —Y—$R^2$ is to cause the leuco dye to be capable of resisting migration, i.e., to be thermally immobile. Resistance to migration can be further enhanced by the use of suitable barrier layers. The molecular weight of $R^2$ should be sufficiently high to render the ballasted leuco dye of formula I thermally immobile. The molecular weight of —Y—$R^2$ is preferably at least about 183, more preferably at least about 237, and most preferably at least about 337. Representative examples of $R^2$ include long chain aliphatic groups, e.g., having at least 8 carbon atoms, aromatic rings containing a long chain aliphatic group, e.g., having at least 8 carbon atoms, preferably an aromatic ring containing a long chain alkoxy group, e.g., having at least 8 carbon atoms. Representative examples of —Y—$R^2$ groups include —CO—$C_6H_4$—O—$C_8H_{16}$—OH,
—CO—$C_6H_4$—O—$C_{12}H_{25}$,
—CO—$C_6H_4$—O—$C_{18}H_{37}$,
—CO—$C_6H_4$—O—$C_{22}H_{45}$, and
—CO—$C_6H_4$—O—CO—NH—$(CH_2)_{36}$—NH—CO—$OCH_3$.

In general, there will only be one leuco dye group (i.e., reduced chromophore of a thermally mobile dye) for each —Y—$R^2$ group.

The molecular weight of —Y—$R^2$ must not be so high that the resulting amount of reduced chromophore of the thermally mobile dye in the emulsion layer is insufficient to yield a dye image having a reflection optical density of at least 0.3 or a transmission optical density of at least 0.2.

When $R^3$, $R^4$, W, $R^5$, $R^6$, $R^7$, $R^8$, $R^9$, $R^{10}$, or $R^{11}$ represents an alkyl group, it is preferred that it contain 1 to 4 carbon atoms. When $R^3$, $R^4$, W, $R^5$, $R^6$, $R^7$, $R^8$, $R^9$, $R^{10}$, or $R^{11}$ represents an alkyl group, it can contain various substituents so long as they are inert to the photothermographic system and are not injurious to the quality of the image. Such substituents can include, but are not limited to, halogen, such as chloride, bromide, fluoride, and iodide; hydroxy; and alkoxy, and thioalkoxy, preferably having 1 to 10 carbon atoms, more preferably having 1 to 4 carbon atoms.

As noted above, $R^9$ and $R^{10}$ together may represent the atoms necessary to complete a nucleus of a 5-, 6-, or 7-membered heterocyclic ring group. When completing such a ring group the atoms are generally selected from non-metallic atoms such as C, N, O and S, and each ring group may have one or more substituents as described above. The heterocyclic ring nuclei may be any of those known in the dye art, but. preferred examples include morpholine, pyrrolidine, 4-methylpiperazine, piperidine, and azacycloheptane. In addition, one or more of $R^9$ and $R^{10}$ may represent necessary atoms to complete a 5- or 6-membered heterocyclic ring fused to the phenyl ring on which the $—NR^9R^{10}$ group is attached. The heterocyclic ring nuclei may be any of those known in the dye art, but preferred examples include 1,2-dihydroindole, 1,2,3,4-tetrahydroquinoline, and julolidine.

The preferred color-bearing dyes of this invention, can be prepared as described in H. A. Lubs *The Chemistry of Synthetic Dyes and Pigments*; Hafner; New York, N.Y.; 1955 Chapter 5; in H. Zollinger *Color Chemistry: Synthesis, Preperties and Applications of Organic Dyes and Pigments*; VCH; New York, N.Y.; pp. 67–73, 1987, and in U.S. Pat. No. 5,149,807; and EPO Laid Open Application No. 0,244,399.

The ballasted leuco dyes of this invention can be prepared by reduction and acylation of the color-bearing dye form. Methods of preparing the ballasted leuco dyes (as well as the color-bearing dyes) that are preferred in this invention are described in Japanese Patent No. 52-89131 and U.S. Pat. Nos. 2,784,186; 4,439,280; 4,563,415, 4,570,171, 4,622,395, and 4,647,525, all of which are incorporated herein by reference. For example, alkoxybenzoyl ballasted oxazine leuco dyes can be prepared according to Scheme I below.

Representative examples of ballasted leuco dyes that are within the scope of the invention are listed in Table I as Dyes A, B, C, D, E, F, G, H, J, K, and L. Examples of ballasted leuco dyes that are not within the scope of the invention are listed in Table I as M, N, and O. Dyes M, N, and O are available from Hodogaya Chemical Company., Ltd., Japan.

As is well understood in this technical area, a large degree of substitution is not only tolerated, but is also often advisable. As a means of simplifying the description of substituent groups, the terms "group" and "moiety" are used to differentiate between those chemical species that may be substituted and those which may not be so substituted. Thus, when the term "group" is used to describe a substituent, that substituent includes the basic group and the basic group containing conventional substitution. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. On the other hand., the phrase "alkyl moiety" is limited to the inclusion of only pure hydrocarbon alkyl chains, such as methyl, ethyl, propyl, t-butyl, cyclohexyl, iso-octyl, octadecyl, and the like.

TABLE I

Ballasted Leuco Dyes

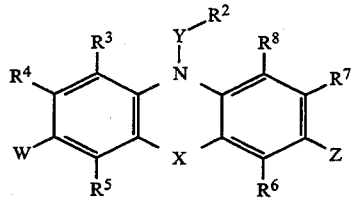

| Leuco Dye | X | Y | $R^2$ | $R^3$–$R^8$ | W | Z |
|---|---|---|---|---|---|---|
| A | S | CO | $—C_6H_4—O—C_{12}H_{25}$ | H | H | OH |
| B | S | CO | $—C_6H_4—O—C_{12}H_{25}$ | H | $N(CH_3)_2$ | $N(CH_3)_2$ |
| C | S | CO | $—C_6H_4—O—C_{12}H_{25}$ | H | $N(C_2H_5)_2$ | $N(C_2H_5)_2$ |
| D | S | CO | $—C_6H_4—O—C_{12}H_{25}$ | H | $N(CH_3)_2$ | OH |
| E | O | CO | $—C_6H_4—O—C_{18}H_{37}$ | H | $N(C_2H_5)_2$ | $N(C_2H_5)_2$ |
| F | S | CO | $—C_{11}H_{23}$ | H | H | OH |
| G | O | CO | $—C_6H_4—O—CO—NH—(CH_2)_{36}—NHCO—OCH_3$ | H | $N(C_2H_5)_2$ | $N(C_2H_5)_2$ |
| H | O | CO | $—C_6H_4—O—CO—O—$Cholesteryl | H | $N(C_2H_5)_2$ | $N(C_2H_5)_2$ |
| J | O | CO | $—C_6H_4—O—C_8H_{16}—OH$ | H | $N(C_2H_5)_2$ | $N(C_2H_5)_2$ |
| K | O | CO | $—C_6H_4—O—C_{12}H_{25}$ | H | $N(C_2H_5)_2$ | $N(C_2H_5)_2$ |
| L | O | CO | $—C_6H_4—O—C_{22}H_{45}$ | H | $N(C_2H_5)_2$ | $N(C_2H_5)_2$ |
| M | O | CO | $—C_6H_5$ | H | $N(C_2H_5)_2$ | $N(C_2H_5)_2$ |
| N | O | CO | $—C_6H_4—CH_3$ | H | $N(C_2H_5)_2$ | $N(C_2H_5)_2$ |
| O | O | CO | $—C_6H_4—O—CH_3$ | H | $N(C_2H_5)_2$ | $N(C_2H_5)_2$ |

Note: All substituants on $—C_6H_4—$ in $R^2$ are in the para position.

Scheme I - Preparation of Alkoxy Substituted Ballasted Leuco Dyes

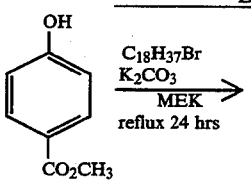

-continued

Scheme I - Preparation of Alkoxy Substituted Ballasted Leuco Dyes

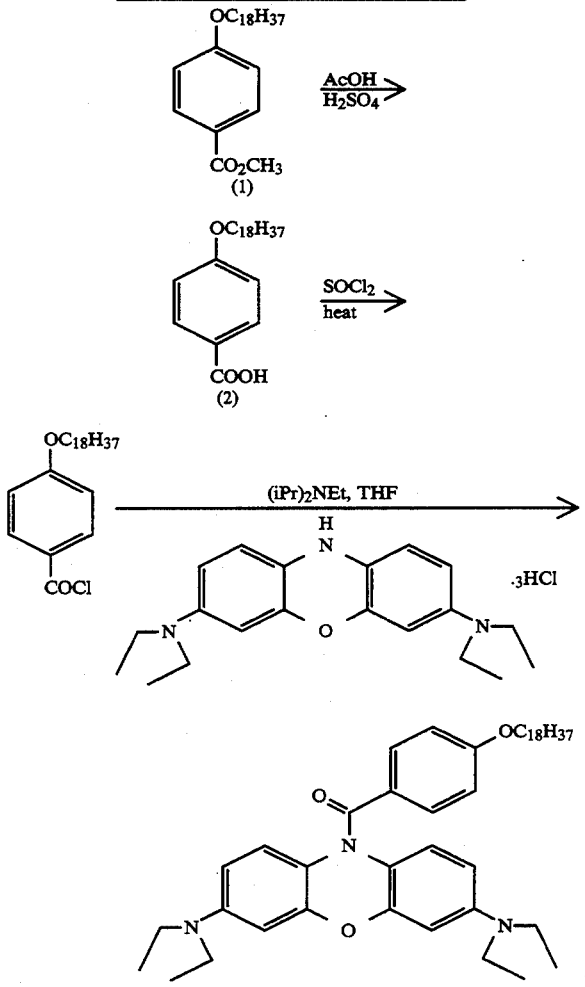

where
MEK = methyl ethyl ketone (2-butanone)
AcOH = acetic acid
$(iPr)_2NEt$ = diisopropylethylamine
THF = tetrahydrofuran

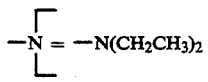

The ballasted leuco dye is contained within a single layer of the photothermographic element and should be capable of resisting migration to an adjacent layer. After imaging, and upon oxidation, the ballasting group, —Y—$R^2$, is cleaved, producing the color-bearing dye, which, upon heating, diffuses to an image-receiving layer, thereby providing a colored image of high resolution. Diffusion can be assisted by means of a solvent. In the areas exposed to light, the cleaved ballasting group, the silver image, and any unoxidized ballasted leuco dye are retained in the layer of the photothermographic element. In the areas not exposed to light, the ballasted leuco dye is retained in the photothermographic element. In this manner, background stains and muddy colors in the image-receiving layer are significantly reduced.

A sufficient amount of ballasted leuco dye should be present to yield a dye image having a reflection optical density of at least 0.3 or a transmission optical. density of at least 0.2. The ballasted leuco dye is preferably present at a level of at least 1% by weight of the emulsion layer, preferably at least 5% by weight of the emulsion layer, and most preferably from 5% to 20% or more by weight of the emulsion layer.

The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver. The photosensitive silver halide is preferably present at a level of 0.01 to 15 percent by weight of the emulsion layer, although higher amounts, e.g., up to 20 to 25 percent, are useful. It is more preferred to use from 1 to 10 percent by weight photosensitive silver halide in the emulsion layer and most preferred to use from 1.5 to 7.0 percent by weight. The photosensitive silver halide can be chemically and spectrally sensitized in a manner similar to that used to sensitize conventional wet process silver halide or state-of-the-art heat-developable photographic materials.

The light-insensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70 percent by weight of the emulsion layer. It is preferably present at a level of 30 to 55 percent by weight of the emulsion layer.

It is preferred that the binder be sufficiently polar to hold the other ingredients of the emulsion in solution. It is preferred that the binder be selected from polymeric materials, such as, for example, natural and synthetic resins, such as gelatin, polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers. The polyvinyl acetals, such as polyvinyl butyral and polyvinyl formal, and vinyl copolymers such as polyvinyl acetate and polyvinyl chloride are particularly preferred. The binders are generally used at a level of from about 20 to about 75 percent by weight of the emulsion layer, and preferably from about 30 to about 55 percent by weight. Where the proportions and activities of leuco dyes require a particular developing time and temperature, the binder should be able to withstand those conditions. Generally, it is preferred that the binder not decompose or lose its structural integrity at 200° F. (90° C.) for 30 seconds, and more preferred that it not. decompose or lose its structural integrity at 300° F. (149° C.) for 30 seconds. The binder can be oleophilic or hydrophilic. Selection of the appropriate binder, with respect to oleophilicity and hydrophilicity, is dependent upon the particular ballasted leuco dye selected.

Development modifiers can be used at a level of 0.01 to 10 percent by weight of the emulsion layer. Representative examples of development modifiers include aromatic carboxylic acids and their anhydrides, such as phthalic acid, 1,2,4-benzenetricarboxylic acid, 2,3-naphthalene-dicarboxylic acid, tetrachlorophthalic acid, 4-methyl-phthalic acid, homophthalic acid, 4-nitrophthalic acid, o-phenylacetic acid, naphthoic acid, phthalic anhydride, naphthalic anhydride, tetrachlorophthalic anhydride, and the like.

The use of toners, such as phthalazinone, and both phthalazine and phthalic acid, or derivatives thereof, is highly desirable, but is not essential to the construction. These materials may be present in amounts of from 0.01 to 10 percent by weight of the emulsion layer.

Stabilizers, such as phenidone, catechol, hydroquinone, and mixtures thereof, may also be added to the emulsion layer.

The formulation for the photothermographic emulsion layer can be prepared by dissolving the photosensitive silver halide, the source of reducible silver, the leuco dye, optional additives, and the binder in an inert organic solvent, such as, for example, acetone, 2-butanone or tetrahydrofuran.

The formulation can be coated onto a support by methods well known in the art, such as, for example, wire-wound rod, knife, or extrusion coating. Typical wet thickness of the emulsion layer can range from about 10 to about 100 micrometers (μm), and the layer can be dried in forced air at temperatures ranging from 20° C. to 100° C. It is preferred that the thickness of the layer be selected to provide maximum image densities greater than 0.2, and more preferably in the range 0.5 to 2.5, as measured by a MacBeth Color Densitometer Model TD 504 using the color filter complementary to the dye color.

Alternatively, the formulation may be spray-dried to produce solid particles, which can then be redispersed in a second, possibly different, binder and then coated onto the support, as described in U.S. Pat. No. 4,708,928, incorporated herein by reference.

The formulation for the emulsion layer can also include coating aids such as fluoroaliphatic polyesters.

The support or substrate of the photothermographic element can be selected from a wide range of materials, including paper, glass, metal, polymeric film, and the like, depending upon the particular imaging requirement. Preferred materials for the support include polymers having good heat stability, such as polyesters. A particularly preferred polyester is polyethylene terephthalate.

Barrier layers, which are alternatively commonly referred to as interlayers, preferably comprising a polymeric material, can also be present in the photothermographic element of the present invention. Polymers for the material of the barrier layer can be selected from natural and synthetic polymers such as gelatin, polyvinylalcohols, polyacrylic acids, sulfonated polystyrene, and the like. The polymers can optionally be blended with barrier aids such as silica.

Images derived from the photothermographic element are typically transferred to an image-receiving layer. The image-receiving layer of this invention can be any flexible or rigid, transparent layer made of thermoplastic polymer. The image-receiving layer preferably has a thickness of at least 0.1 micrometer, more preferably from about 1 to about 10 micrometers, and a glass transition temperature of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidene chloride; polyvinyl acetate; copolymer of vinylchloride-vinylacetate; copolymer of vinylidene chloride-acrylonitrile; copolymer of styrene-acrylonitrile; and the like.

The optical density of the dye image and even the actual color of the dye image in the image-receiving layer is very much dependent characteristics on the polymer of the image-receiving layer, which acts as a dye mordant, and, as such, is capable of absorbing and fixing the dyes. A dye image having a reflection optical density in the range of from 0.3 to 3.5 (preferably from 1.5 to 3.5) or a transmission optical density in the range of from 0.2 to 2.5 (preferably from 1.0 to 2.5) can be obtained with the present invention.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image receiving layers are described in U.S. Pat. No. 4,594,307, incorporated herein by reference.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight percent of the emulsion layer, preferably from about 0.1 to about 0.3 weight percent. A representative example of such a fluoroaliphatic polyester is "Fluorad FC 431", commercially available from Minnesota Mining and Manufacturing Co. .Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer to facilitate transfer of the dye that forms after the imagewise exposed emulsion layer is subjected to thermal development, for example, in a heated shoe and roller type heat processor.

In another embodiment, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Multi-color images can be prepared by superimposing in register, imaged image-receiving layers as prepared above. The polymers of the individual imaged image-receiving layers must be sufficiently adherent to provide useful multi-color reproduction on a single substrate.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer.

The material of this invention can be used for example, in conventional color photography, in electronically generated color hardcopy recording, and in digital color proofing in the graphic arts area. The material of this invention provides high photographic speed, provides pure dye images, and provides a dry and rapid process.

Objects and advantages of this invention will now be illustrated by the following examples, but the particular materials and amounts thereof recited in these examples, as well as other conditions and details, should not be construed to unduly limit this invention. All percentages are by weight unless otherwise indicated.

EXPERIMENTAL PREPARATIONS

Preparation of 4-Octadecyloxybenzoy1-3,7-bis(N,N-diethylamino)oxazine (Dye E of Table I)

Methyl 4-octadecyloxybenzoate:

A mixture containing methyl 4-hydroxybenzoate (45.6 g), octadecylbromide (100 g), and potassium carbonate (41.4 g) in 2-butanone (200 ml) was heated at reflux for 16 hours. The solvent was then removed until 125 ml of 2-butanone had been collected. While it was still warm, the remaining material was poured into methanol (400 ml). The product was filtered and recrystallized from 2000 ml of methanol to give methyl 4-octadecyloxybenzoate (55 g).

4-Octadecyloxybenzoic acid:

A mixture containing methyl 4-octadecyloxybenzoate (30 g) and acetic acid (10 ml) was warmed until a solution was obtained. To this solution was added concentrated sulfuric acid (3 ml), and the mixture heated to slowly distill off the methyl acetate. This distillation was carried out over a period of 40 minutes. The solution was then cooled just below the boiling point and stirred for an additional 30 minutes. The hot reaction mixture was poured onto cold water and the solid filtered and dried. The product was then slurried in methylene chloride (100 ml) then filtered. The solid was recrystallized from 2-butanone to give 4-octadecyloxybenzoic acid (24 g).

4 -Octadecyloxybenzoyl-3,7 -bis(N, N-diethylamino)oxazine (Dye E of Table I):

To thionyl chloride (15 ml) was added 4-octadecyloxybenzoic acid (6 g) (2). The mixture was heated at reflux until gas evolution stopped. The remaining thionyl chloride was removed with heat and water aspirator to give the crude acid chloride, which was used directly in the next step.

A mixture containing trihydrochloride salt of 3,7-bis(N,N-diethylamino)oxazine (6.8 g) and tetrahydrofuran (200 ml) was purged with nitrogen for 10 minutes. To the mixture was added diisopropylethylamine (8.0 g). The resulting mixture was stirred for 15 minutes at room temperature. A solution of the crude acid chloride in tetrahydrofuran (50 ml) was then added over a period of one hour. The mixture was stirred for one hour and then filtered to remove the salts. The solvent was removed by means of a vacuum, and 200 ml of heptane was added. The heptane was also removed by means of a vacuum, which also resulted in the removal of the last traces of tetrahydrofuran. The residue was extracted three times with hot hexane (150 ml). The residue was concentrated and chromatographed on silica gel. Elution with 10 percent ethyl acetate in hexane gave 6.3 g of leuco dye E. An analytical sample was obtained by recrystallization in hexane cooled in ice water (m.p. 64°–66° C.).

Preparation of Dyes G, H, J, K, and L 3,7-bis(diethylamino)..-10-(4-acetoxybenzoyl)-phenoxazine:

A solution of 3,7-bis(N,N-diethylamino)-oxazine (basic blue III) (3.75 g, 0.0118 mol) and 250 ml of water was prepared in a 1L round-bottomed flask. The solution was purged with nitrogen, the pH was raised to 10 by addition of 2.5 M aqueous sodium hydroxide solution, and 150 ml of dichloromethane was added. The dye was reduced by addition of sodium dithionite (6.0 g). When the dye was reduced, as evidenced by a color change from blue to yellow, p-acetoxybenzoyl chloride (2.38 g, 0.012 mol)was added. Stirring of the solution was maintained for 5 hours. After this period, the layers were separated, the organic layer was washed with dilute aqueous sodium hydroxide, brine, then treated with colloidal clay, (Engelhard Corp., Edison, N.J.) "Attagel 50" and filtered. Solvent removal at reduced pressure provided 3,7-bis(diethylamino) 10-(4-acetoxybenzoyl)phenoxazine as a green foam (5.08 g).

p-Acetoxybenzoyl chloride was prepared by adding oxalyl chloride (3.10 g, 0.024 mol, 2.13 ml) to a slurry of p-acetoxybenzoic acid (21.9 g, 0.0112 mol) in 5 ml of toluene, heating the resulting mixture at a temperature of 60° C. overnight and removing solvent in vacuo .

4-hydroxybenzoyl-3,7-bis(N,N-diethylamino)oxazine:

To a solution of 3,7-bis(diethylamino)-10-(4-acetoxybenzoyl)phenoxazine (1.0 g, 2.10 mmol) in 10 ml of methanol was added 25 ml of saturated aqueous sodium. bicarbonate solution. The resulting solution was stirred under a nitrogen atmosphere and the progress of the reaction monitored by thin layer chromatography. After 48 hours, no starting material remained. The mixture was concentrated in vacuo, water and ether were added, and the layers separated. The ether layer was washed with water, dried over magnesium sulfate, and concentrated in vacuo to provide 4-hydroxybenzoyl-3,7-bis(N,N-diethylamino)oxazine (p-hydroxybenzoyl-basic blue III) as a light blue foam (0.68 g).

Preparation of C-36 carbamate-3,7-bis-(N,N-diethylamino) oxazine (Dye G of Table I)

To a solution of p-hydroxybenzoylbasic blue III (0.228 g, 0.512 mmol) in dry toluene (25 mL) was added the compound "DDI-1410" (0.614 g, 1.02 mmol) and a catalytic amount of dibutyltindilaurate. The formula of compound "DDI-1410" is O=C=N—$(CH_2)_{36}$—N=C=O and is available from Henkel Chemical Co.

After heating at reflux for 5 hours, the solution was cooled to room temperature and quenched with methanol. Solvent was evaporated in vacuo, and the product purified by column chromatography to give leuco oxazine dye G of Table I as a yellow oil (0.54 g).

Preparation of 4-cholesterylbenzoy-3,7-bis(N,N-diethylamino)oxazine (Dye H of Table I)

A mixture of p-hydroxybenzoylbasic blue III (0.250 g, 0.562 mmol), cholesteryl chloroformate (0.504 g, 1.12 mmol), and triethylamine (0.08 mL) in dichloromethane (25 mL) was stirred at room temperature for 30 minutes. The solution was washed with dilute HCl and brine, dried, filtered through a small plug of colloidal clay ("Attagel 50" Engelhard Corp , Edison, N.J.), and concentrated in vacuo to give leuco oxazine dye H of Table I (0.298 g).

Preparation of 4-(8-hydroxyoctyloxy)benzoy-3,7-bis(N,N-diethylamino)oxazine (Dye J of Table I)

8-Iodooctan-1-ol:

A mixture of 8-chlorooctan-1-ol (25 g, 152 mmol) and sodium iodide (125 g, 834 mmol) in acetone (500 ml) was heated at reflux overnight. The mixture was filtered to remove precipitated sodium chloride, the filtrate was evaporated in vacuo, and the residue partitioned between water (200 ml) and ether (200 ml). The ether layer was separated, washed with 1M sodium thoisulfate solution (200 ml), and dried over anhydrous magnesium sulfate. Filtration, and solvent removal in vacuo, afforded 8-iodooctan-1-ol as a colorless oil (34.85 g, 90%).

4-(8-hydroxyoctyloxy)benzoyl-3,7-bis(N,N-diethylamino)oxazine (Dye J of Table I):

A mixture of p-hydroxybenzoylbasic blue III (28.0 g, 0.063 mol), 8-iodooctan-1-ol (16.0 g, 0.062 mol), and of calcium carbonate (24.8 g, 0,250 mol) in 400 ml of dry tetrahydrofuran was stirred and heated at reflux overnight. The progress of the reaction was followed by thin layer chromatography (50% ethyl acetate/petroleum ether). An additional 1 to 2 g of 8-iodooctan-1-ol and calcium carbonate were added and the mixture refluxed an additional 1 to 2 hrs. The reaction mixture was allowed to cool, was filtered, and the solvent removed in vacuo. The crude material was dissolved in ether, washed with water, and the organic layer was dried over anhydrous magnesium sulfate. Filtration to remove drying agent, followed by solvent removal in vacuo gave the crude material as a brown oil.

The crude material was purified by column chromatography on silica gel and elution with 70% ethyl acetate/petroleum ether followed by 50% ethyl acetate/petroleum ether. The compound eluted as a yellow material. Solvent removal in vacuo afforded 4-(8-hydroxyoctyloxy)benzoyl-3,7-bis(N,N-diethylamino)oxazine (23.5 g, 67%).

Preparation of 4-Dodecyloxybenzoyl-3,7-bis (N,N-diethylamino)oxazine (Dye K of Table I)

Methyl 4-dodecyloxybenzoate:

This compound was prepared from methyl 4-hydroxybenzoate and dodecylbromide in an analogous manner to that described above for methyl 4-octadecyloxybenzoate.

4-Dodecyloxybenzoic acid:

This compound was prepared by hydrolysis of methyl 4-dodecyloxybenzoate in a manner analogous to that described above for 4-octadecyloxybenzoic acid.

4-Dodecyloxybenzoyl-3,7-bis)N,N-diethylamino)oxazine (Dye K of Table I):

This compound was prepared from 4-dodecylbenzoyl chloride and 3,7-bis(N,N-diethylamino)oxazine in a manner analogous to that described above for dye E.

Preparation of 4-Docosyloxybenzoy1-3,7-bis (N,N-diethylamino)oxazine (Dye L of Table I)

Methyl 4-docosyloxybenzoate: This compound was prepared from methyl 4-hydroxybenzoate and docosylbromide ($C_{22}H_{45}Br$) in an analogous manner to that described above for methyl 4-octadecyloxybenzoate.

4-Docosyloxybenzoic acid:

This compound was prepared by hydrolysis of methyl 4-docosyloxybenzoate in a manner analogous to that described above for 4-octadecyloxybenzoic acid.

4-Docosyloxybenzoyl-3,7-bis(N,N-diethylamino)-oxazine (Dye L of Table I):

This compound was prepared from 4-docosylbenzoyl chloride and 3,7-bis(N,N-diethylamino)oxazine in a manner analogous to that described above for dye E.

Preparation of Photothermographic Elements

The method of preparation and evaluation of photothermographic elements of the present invention is illustrated below.

Silver Emulsion:

A dispersion of silver behenate half soap (1 mol of silver behenate to 1 mol of behenic acid, 10% solids) in a mixture of toluene (10%) and ethyl alcohol (90%) was made by a homogenization process. A portion of the half soap dispersion (110 g) was diluted with ethyl alcohol (340 g) and isopropyl alcohol (40 g). Then polyvinylbutyral (0.4 g, "Butvar", Monsanto Company) was added to the diluted dispersion and dissolved.

A 10 ml portion of mercury bromide solution (0.36 g in 20 ml of methyl alcohol) was added to the dispersion with stirring. An additional 26 g of polyvinylbutyral was added to the dispersion and dissolved. This dispersion is hereinafter referred to as Dispersion A.

Receptor Layer:

A 15% solution of a copolymer of vinylchloride (90 mol %) and vinyl acetate (10 mol %) ("UCAR VYNS-3" Union Carbide Corp ) in a mixture of 2-butanone (50%) and toluene (50%) was coated at a wet thickness of 0.08 mm onto an opaque polyester film ("Melinex 994" ICI Americas Inc ) and dried in an oven at a temperature of 80° C. for five minutes to form an image-receiving (receptor) layer.

Strippable Blank Emulsion Layer:

Three drops of a fluorocarbon coating additive ("Fluorad FC431", Minnesota Mining and Manufacturing Company) were added to 25 g of Dispersion A as a stripping agent, and the resulting dispersion mixed. The resulting mixed dispersion was coated onto the receptor layer at a wet thickness of 80 μm and dried in an oven at 80° C. for five minutes to form a strippable blank emulsion layer.

Interlayer: A solution of polyvinylchloride (3.5% solids) (VC 106 PM, Borden) in tetrahydrofuran was coated onto the blank emulsion layer at a wet thickness of 80 μm and dried in an oven at a temperature of 80° C. for five minutes to form an interlayer.

Photosensitive Layer:

Emulsions containing a cyan leuco dye were prepared by dissolving the cyan leuco dye (0.43 mmol), a red sensitizing dye (1 ml of a solution containing 0.005 g of dye in 150 ml of toluene and 50 ml of methanol), and 0.50 mmol of 4-methylphthalic acid in 3 ml of toluene. The resulting solution was added to 25 g of Dispersion A, and the resulting dispersion mixed and coated onto the interlayer at a wet thickness of 0.13 mm and dried in an oven at a temperature of 80° C. for five minutes to form a cyan emulsion layer.

EXPERIMENTAL EXAMPLES

Examples 1–6 and Comparative Examples C1–C3

Seven different cyan leuco dyes were tested in photothermographic emulsions prepared as described above. The identities of the dyes are set forth below in Table II. The dyes are depicted in Table I.

TABLE II

| Testing of Dyes in Photothermographic Elements | |
|---|---|
| Example No. | Dye (from Table I) |
| 1 | J |
| 2 | K |
| 3 | E |
| 4 | L |
| 5 | G |
| 6 | H |
| C1 | M |
| C2 | N |
| C3 | O |

The dyes of Working Examples 1, 2, 3, 4, 5, and 6 are within the scope of the present invention. The dyes of Comparative Examples C1, C2, and C3 are commercially available from Hodogaya Chemical Co., Ltd.

The red sensitizing dye used in Comparative Examples C1, C2, and C3 and in Working Examples 1, 2, 3, 4, 5, and 6 is disclosed in in U.S. Pat. No. 3,719,495 and has the following structural formula:

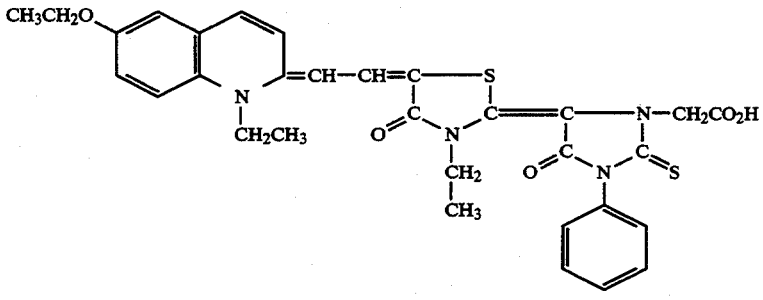

Samples cut from photothermographic elements of Examples 1–6 and Comparative Examples C1–C3 were divided into two groups. One group, hereinafter Group I, was used to determine if any leuco dye had migrated to the receptor layer during coating and drying operations. The other group, hereinafter Group II, was used to determine if any leuco dye had migrated to the receptor layer during thermal imaging and development at elevated temperatures.

Evaluation of Samples from Group I

A portion of the photothermographic element containing the emulsion layers and the interlayer that had not been exposed to light and had not been heat-developed was stripped away from the image-receiving layer.

N-Bromosuccinimide solution (approximately 0.015 ml of a solution of 0.79 g in a mixture of 50 ml of acetone and 50 ml of toluene) was placed on the image-receiving layer. In instances where the leuco dye had migrated through the interlayer and into the image-receiving layer during coating and the drying operations, the leuco dye that had migrated was oxidized by the N-bromosuccinimide and colored the image-receiving layer. In instances where no leuco dye had migrated to the image receiving layer when the N-bromosuccinimide was placed on the image-receiving layer, no color was observed in the image-receiving layer.

These tests show that none of the leuco dyes migrated to the image-receiving layer during the solvent coating and drying operations and further indicate that the interlayer had functioned effectively as a barrier during the solvent coating and drying operations.

Evaluation of Samples from Group II

The second group of samples cut from the aforementioned photothermographic elements were exposed in an EG&G sensitometer through a Wratten 25 red filter for $10^{-3}$ second to produce heat-developable latent images in the emulsion layer. The images were then developed on a heat blanket at a temperature of 140° C. for 30 seconds. The portion of the element containing the photothermographic emulsion layers and the interlayer was then stripped away from the image-receiving layer. Dye images in the image-receiving layer corresponding to the light exposed areas of the sheets were measured by a densitometer with a red filter. The results of the sensitometric data obtained from each sample are set forth in Table III.

The N-bromosuccinimide solution was placed on the unimaged area of the image-receiving layer, which area corresponded to the unexposed area of the photothermographic emulsion layer, to observe the migration of the leuco dye to the image-receiving layer during the heat development at 140° C. When the N-bromosuccinimide oxidizing agent was placed on the image-receiving layer, cyan dye was formed. Optical densities of the cyan dye images were measured by a densitometer with red filter. The results are set forth in Table III.

The data in Table III indicate that the leuco dyes of the photothermographic elements of Examples 1-6 have have significantly lower tendency to migrate to the image-receiving layer and better background stability (ΔDmin.) than do the leuco dyes of the photothermographic elements of Examples C1-C3. As used herein "Dmin" means the minimum optical image density in exposed regions; and "Dmax" means the maximum optical image density in exposed regions.

The samples having the dye images were then placed in a light chamber (1,200 foot candle, 27° C., 65% RH) for 100 hours to observe changes in the optical densities. The results of these tests are also set forth in Table III.

TABLE III

Evaluation of Leuco Dyes in Photothermographic Elements

| | Example | | | | | | | | |
|---|---|---|---|---|---|---|---|---|---|
| | C1 | C2 | C3 | 1 | 2 | 3 | 4 | 5 | 6 |
| $D_{min}$ | 0.10 | 0.11 | 0.26 | 0.23 | 0.15 | 0.14 | 0.29 | 0.17 | 0.09 |
| $D_{max}$ | 1.66 | 2.00 | 2.39 | 2.22 | 2.24 | 2.24 | 2.14 | 1.87 | 0.77 |
| Ergs/cm$^2$ at 0.6 D | 355 | 204 | 141 | 132 | 148 | 191 | 186 | 420 | 1,740 |
| Migration of Leuco Dye (NBS Drop Test) | 1.18 | 1.13 | 1.20 | 0.69 | 0.68 | 0.46 | 0.38 | 0.65 | 0.52 |
| Print Stability | | | | | | | | | |
| Inital $D_{min}$ | 0.10 | 0.11 | 0.26 | 0.23 | 0.15 | 0.14 | 0.29 | 0.18 | 0.09 |
| Inital $D_{max}$ | 1.63 | 2.02 | 2.38 | 2.25 | 2.30 | 2.22 | 2.28 | 1.87 | 0.77 |
| $D_{min}$ after 100 hrs. | 0.44 | 0.41 | 0.47 | 0.37 | 0.29 | 0.21 | 0.33 | 0.32 | 0.18 |
| $D_{max}$ after 100 hrs. | 1.76 | 2.06 | 2.44 | 2.20 | 2.25 | 2.14 | 2.13 | 1.82 | 0.70 |
| Δ $D_{min}$ | +.034 | +0.30 | +.21 | +0.14 | +0.14 | +0.07 | +0.04 | +0.14 | +0.08 |
| Δ $D_{max}$ | +0.13 | +0.04 | +0.06 | −0.05 | −0.05 | −0.08 | −0.15 | −0.05 | −0.07 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A photothermographic element comprising a support bearing an emulsion comprising:
   (a) a photosensitive silver halide,
   (b) an organic silver compound,
   (c) a binder, and
   (d) a reducing agent for silver ion, said reducing agent being a leuco dye having the general formula:

D—B wherein

D represents the reduced chromophore of a thermally mobile, color-bearing dye; and B represents an organic group that reduces the thermal mobility of said leuco dye D—B in said binder, said organic group B capable of being oxidatively cleaved from said leuco dye D—B to form a color-bearing dye, said element further comprising an image-receiving layer capable of absorbing and retaining said color-bearing dye when said organic group B has been oxidatively cleaved from said leuco dye D—B.

2. The element of claim 1 wherein said leuco dye has the structural formula

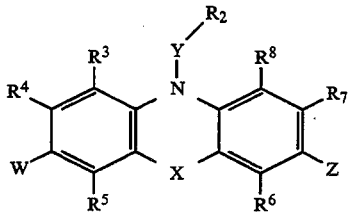

wherein

X represents a member selected from the group consisting of S, O and N—$R^1$;

$R^1$ represents a member selected from the group consisting of alkyl groups and aryl groups;

Y—$R^2$ represents an organic group which may be oxidatively cleaved, wherein

Y represents a member selected from the group consisting of, $$-\overset{O}{\overset{\|}{C}}-O-,\ -\overset{O}{\overset{\|}{C}}-NH-,\ -\overset{O}{\overset{\|}{C}}-,\ \text{and}\ -SO_2-,\ \text{and}$$

$R^2$ represents a ballasting group;

$R^3$, $R^4$, $R^5$, $R^6$, $R^7$, and $R^8$ independently represents a member selected from the group consisting of hydrogen, halogens, and alkyl groups, and aromatic rings fused in the 1,2 and 8,9 positions;

W represents a member selected from the group consisting of hydrogen, alkyl groups, alkoxy groups, —OH, —SH, —NHCOR$^9$, —OCOR$^9$, and —NR$^9$R$^{10}$;

Z represents a member selected from the group consisting of —OH, —SH, —NHCOR$^9$, —OCOR$^9$, and —NR$^9$R$^{10}$;

$R^9$ and $R^{10}$ independently represents a member selected from the group consisting of hydrogen, alkyl groups, aryl groups, aralkyl groups, 1-naphthoyl group, and 2-naphthoyl group, provided that if either $R^9$ or $R^{10}$ is hydrogen, the other is not hydrogen; or $R^9$ and $R^{10}$ together may represent the necessary atoms to complete a 5-, 6-, or 7-membered heterocyclic: ring group; or one or more of $R^9$ or $R^{10}$ may represent the atoms necessary to complete a 5- or 6-membered heterocyclic ring group fused to the phenyl ring on which the —NR$^9$R$^{10}$ group is attached.

3. The element of claim 2 wherein Y represents $$-\overset{\overset{\displaystyle O}{\|}}{C}-.$$

4. The element of claim 2 wherein $R^2$ represents a aliphatic group having at least 8 carbon atoms.

5. The element of claim 2 wherein $R^2$ represents an aromatic ring containing a aliphatic group having at least 8 carbon atoms.

6. The element of claim 5 wherein said aliphatic group is an alkoxy group.

7. The element of claim 2 wherein the molecular weight of $-Y-R^2$ is sufficiently low that the amount of said reducing agent in the emulsion layer is sufficient to yield a dye image having a reflection optical density of at least 0.3 or a transmission optical density of at least 0.2.

8. The element of claim 2 wherein the molecular weight of $-Y-R^2$ is at least 183.

9. The element of claim 2 wherein the molecular weight of $-Y-R^2$ is at least 237.

10. The element of claim 2 wherein the molecular weight of $-Y-R^2$ is at least 337.

11. The element of claim 1, wherein said leuco dye is present in an amount sufficient to yield a dye image having a reflection optical density of at least 0.3 or a transmission optical density of at least 0.2

12. The element of claim 1 wherein the molecular weight of B is sufficiently low that the amount of said reducing agent in the emulsion layer is sufficient to yield a dye image having a reflectionoptical density of at least 0.3 or a transmission optical density of at least 0.2

13. The element of claim 1 wherein said image receiving layer comprises a thermoplastic resin.

14. A method of producing an image which comprises the steps of imagewise exposing the element of claim 1 and thereafter heating the element to develop said image.

15. A method for forming an image comprising the steps of:

(1) providing a photothermographic element comprising a support bearing a photosensitive layer comprising:
   (a) a photosensitive silver halide,
   (b) an organic silver compound,
   (c) a binder, and
   (d) a reducing agent for silver ion, said reducing agent beinq a leuco dye having the general formula:

D—B wherein D represents the reduced chromophore of a thermally mobile, color-bearing dye; and B represents an organic group that reduces the thermal mobility of said leuco dye D—B in said binder, said organic group B capable of being oxidatively cleaved from said leuco dye D—B to form a color-bearing dye, from D (2) providing an image-receiving sheet capable of absorbing and retaining said color-bearing dye when said organic group B has been oxidatively cleaved from said leuco dye D—B, (3) imagewise exposing said photothermographic element to form a latent image (4)placing said image-receiving sheet in face-to-face contact with said exposed photosensitive layer of said photothermographic element during development to receive a visible image, (5) developing said imagewise exposed element to convert said latent image into a visible image, and (6) after said visible image is received, stripping said image-receiving sheet is from said element.

16. The method of claim 15, wherein said element is heated for a period of time of from 0.5 to 300 seconds at a temperature of from 80° C. to 220° C. to develop said latent image.

* * * * *

UNITED STATES PATENT AND TRADEMARK OFFICE

CERTIFICATE OF CORRECTION

PATENT NO. : 5,424,183

DATED : June 13, 1995

INVENTOR(S) : Ishida et al.

It is certified that error appears in the above-indentified patent and that said Letters Patent is hereby corrected as shown below:

Column 1, line 43, delete "source."
and insert --source--.

Column 4, line 21, delete "-OCOR"
and insert ---$OCOR^9$--.

Column 7, line 28, delete "*Preperties*"
and insert --*Properties*--.

Column 9, line 68, delete "optical."
and insert --optical--.

UNITED STATES PATENT AND TRADEMARK OFFICE

CERTIFICATE OF CORRECTION

PATENT NO. : 5,424,183

DATED : June 13, 1995

INVENTOR(S) : Ishida et al.

It is certified that error appears in the above-indentified patent and that said Letters Patent is hereby corrected as shown below:

Column 10, line 60, delete "not."
and insert --not--.

Column 15, line 36, delete "benzoy"
and insert --benzoyl--.

Column 19, line 45, delete "an emulsion"
and insert --an emulsion layer--.

Signed and Sealed this

Seventeenth Day of October, 1995

Bruce Lehman

*Attest:*

BRUCE LEHMAN

*Attesting Officer*

*Commissioner of Patents and Trademarks*